US005858027A

United States Patent [19]

Cameron

[11] Patent Number: 5,858,027

[45] **Date of Patent: *Jan. 12, 1999**

[54] ENHANCING FUEL EFFICIENCY AND ABATING EMISSIONS OF ENGINES

[76] Inventor: Charles E. Cameron, 829 Amye St., Fayetteville, N.C. 28301

[ * ] Notice: The term of this patent shall not extend beyond the expiration date of Pat. No. 5,595,576.

[21] Appl. No.: 743,642

[22] Filed: Nov. 4, 1996

Related U.S. Application Data

[63] Continuation of Ser. No. 325,203, Jan. 24, 1995, Pat. No. 5,595,576.

[51] Int. Cl.[6] ..... C10L 1/24

[52] U.S. Cl. ..... 44/321; 44/358

[58] Field of Search ..... 44/321, 358

[56] References Cited

U.S. PATENT DOCUMENTS

| | | | |
|---|---|---|---|
| 2,151,432 | 3/1939 | Lyons et al. | 44/9 |
| 3,597,668 | 8/1971 | Yoshimine | 123/119 |
| 4,121,543 | 10/1978 | Hicks, Jr. et al. | 123/3 |
| 4,336,148 | 6/1982 | Wirth et al. | 44/379 |
| 4,715,325 | 12/1987 | Walker | 123/14 |
| 4,891,050 | 1/1990 | Bowers et al. | 44/67 |
| 5,123,362 | 6/1992 | Kikuchi | 110/341 |
| 5,595,576 | 1/1997 | Cameron | 44/321 |

*Primary Examiner*—Ellen M. McAvoy
*Attorney, Agent, or Firm*—Woodard, Emhardt, Naughton, Moriarty & McNett

[57] ABSTRACT

Described are methods for improving the efficiency or modifying the exhaust emissions of internal combustion engines, which involve the incorporation of selenium compounds in the fuel combusted in the engines. Also described are methods for improving the combustion efficiency of fuel oil by the inclusion of selenium therein.

24 Claims, No Drawings

ENHANCING FUEL EFFICIENCY AND ABATING EMISSIONS OF ENGINES

This application is a continuation of application Ser. No. 08/325,203, filed Jan. 24, 1995 U.S. Pat. No. 5,595,576.

BACKGROUND

The present invention relates generally to the field of internal combustion engines. More particularly, this invention relates to methods and compositions for increasing fuel efficiency and modifying emissions characteristics of internal combustion engines.

The internal combustion engine is unequaled in its primary applications as a portable power source. However, internal combustion engine use has been increasingly criticized largely because of polluting emissions and consumption of finite fuel sources. Consequently, much research has been directed to improving the efficiency (in terms of conserving fuels) and to reducing the production of undesirable emissions (in terms of protecting the environment) of the internal combustion engine. Interestingly, this research has indicated that engine efficiency and emissions abatement do not go hand in hand, but rather are in opposition. A breakthrough that would reverse this situation is still being sought.

Thus, despite extensive research efforts, there remains a need for methods and compositions for enhancing fuel efficiency of internal combustion engines as well as for advantageously modifying their emissions. The present invention addresses these needs.

SUMMARY OF THE INVENTION

One object of this invention is to provide methods for enhancing the fuel efficiency of an internal combustion engine.

Another object of this invention is to provide compositions for enhancing the fuel efficiency of an internal combustion engine.

A further object of this invention is to provide methods for advantageously modifying emissions of an internal combustion engine.

Still another object of this invention is to provide compositions for advantageously modifying emissions of an internal combustion engine.

Still another object of the invention is to provide methods and compositions for improving the combustion properties of fuel oil.

These and other objects are accomplished by preferred embodiments of the invention, one of which relates to a method of enhancing fuel efficiency of an internal combustion engine. This method includes the step of providing in the fuel an effective amount of selenium to enhance the fuel efficiency of the engine.

Another preferred embodiment of the invention relates to a method of advantageously modifying exhaust emission of an internal combustion engine operating on a fuel. This method includes the step of providing in the fuel an effective amount of selenium to modify the exhaust emission of the engine.

Another preferred embodiment of the present invention relates to a modified internal combustion engine fuel which includes an effective amount of selenium to increase the fuel efficiency of an internal combustion engine operating on the fuel.

Still another preferred embodiment of the invention provides a modified internal combustion engine fuel which includes an effective amount of selenium to modify the exhaust emission of an internal combustion engine operating on the fuel.

Still another embodiment of the invention provides a method for improving the combustion properties of fuel oil which comprises adding to the fuel oil an effective amount of selenium to increase the thermal energy generated upon combustion of the fuel oil.

Additional objects, advantages and embodiments of the invention will be apparent from the description which follows.

DESCRIPTION OF PREFERRED EMBODIMENTS

For the purposes of promoting an understanding of the principles of the invention, reference will now be made to certain preferred embodiments and specific language will be used to describe the same. It will nevertheless be understood that no limitation of the scope of the invention is thereby intended, such alterations and further modifications and applications of the principles of the invention being contemplated as would normally occur to one skilled in the art to which the invention relates.

As used herein, the term "internal combustion engine" is used in its broad sense to include engines which operate based upon the internal combustion of a fuel. There are numerous engines based upon this principal, and these will readily be recognized by those of ordinary skill in the area.

Also, the term "fuel efficiency" is used herein in it usual sense, and relates to the efficiency of an internal combustion engine as regards consumption of fuel, i.e. increased fuel efficiency is obtained when the amount of engine output per unit fuel consumed is increased, and vice versa.

Internal combustion engine fuels are also well known and include gasolines, diesel fuels, aviation fuels, jet fuels, etc. These fuels can contain various common additives such as antioxidants, copper deactivators, corrosion inhibitors, anti-icing additives, anti-static additives, contaminants, octane boosters, etc.

In accordance with preferred embodiments of the invention, the fuel for the internal combustion engine will contain an effective amount of selenium. This amount will be effective to increase the fuel efficiency of the engine operating on the fuel and/or to modify the exhaust emissions of the internal combustion engine. In this regard, the form in which selenium is included in the fuel has not proven critical. It may be included as elemental selenium, or in the form of a selenium compound, including organic selenium compounds such as organic selenides, e.g. di-organic substituted selenides such as dialkyl selenides, for instance dimethyl selenide, diethyl selenide, dipropyl selenide, dibutyl selenide, dipentyl selenide, etc. Other compounds of selenium, for example selenium salts and/or oxides, may also be used. Particularly preferred are those selenium compounds which form stable solutions or suspensions with the fuel of interest. In this regard, organic selenium compounds which are soluble in the fuel have been preferred.

The amount of selenium (incorporated as elemental selenium or a selenium compound) included in the fuel to be combusted will vary in accordance with the desired level of enhancement of fuel efficiency and/or modification of emissions. In any event, however, the selenium will be included in the fuel in an amount sufficient to produce a significant, recognizable increase in engine fuel efficiency and/or a significant, recognizable modification of engine emissions.

As to fuel efficiency, it is preferred that sufficient selenium be included to increase fuel efficiency by at least about 5%, more preferably at least about 10%. Regarding emissions, sufficient selenium is desirably included to reduce one or more of carbon monoxide, carbon dioxide, hydrocarbon, and nitrogen oxide emissions by at least about 5%, more preferably at least about 10% (based on total weight of the exhaust). In testing using a level of up to about 1 to 2 parts per million (ppm) by weight of selenium, fuel efficiency increases from about 10% to greater than 50% have been obtained both in testing in a stock automobile powered by an 6-cylinder engine (as measured by increase in miles per gallon obtained under normal driving conditions), in testing as set forth in Examples 1–20 below (as measured by engine run-time per unit fuel consumed) and in testing as set forth in Examples 22–27 below (dynamometry employing a 4-cylinder, 151 cubic inch automobile engine). Using this same amount (1–2 ppm) of selenium, emissions of each of the above-named pollutants has been reduced by greater than 10% and even greater than 20%, as demonstrated in Example 21 below.

In use, the elemental selenium or selenium compound is dissolved or suspended in the fuel to be combusted. This modified fuel can then be used to operate the engine in a conventional fashion. The selenium may be provided directly into the fuel at the desired level, or, alternatively, a premix containing the selenium can be prepared at a higher concentration so that when a predetermined amount of the premix is added to a predetermined amount of fuel, the desired level of selenium is achieved. For example, in one instance, elemental selenium was dissolved in carbon disulfide, and this solution added to gasoline to form a modified fuel for a gasoline-powered internal combustion engine. Of course, other solvents or suspending agents will also be suitable, and those ordinarily skilled in the art will be able to recognize and utilize these other materials without any undue experimentation.

As indicated above, another embodiment of the invention provides a method and composition relating to fuel oil such as that combusted to heat enclosed structures such as homes, commercial facilities, etc. In this embodiment, an effective amount of selenium is added to fuel oil to increase the thermal energy generated upon combusting the fuel oil. The amount of selenium added may vary broadly, but in preferred embodiments will be sufficient to provide at least a 5% increase in the thermal energy generated upon combustion. These amounts may include low amounts, for example from up to about 1 to 2 parts per million of selenium to about 100 ppm of selenium.

For the purposes of promoting a-further understanding and appreciation of the present invention and its preferred aspects and embodiments, the following specific Examples are provided. It will be understood, however, that these Examples are illustrative and not limiting of the invention.

EXAMPLES 1–10 (CONTROL) AND 11–20 (INVENTIVE)

A series of tests was conducted using a Model 1700 Weedeater (gas powered) mounted onto a ladder which provided a stable platform. The engine was first warmed up by running it for ten minutes on regular fuel which consisted of unleaded 87 Octane Sunoco gasoline. Poulan oil was added to the fuel in the usual fashion with this type of engine. The test fuel (Examples 11–20) consisted of the same fuel as the control fuel (Examples 1–10) except that dimethyl selenide was added to make up a solution containing 1.5 ppm (by weight) of dimethyl selenide.

The control tests 1–10 were made first using gasoline which had no additive. Ten runs were made using 100 ml of regular gasoline and running with the throttle wide open until the engine ran out of fuel. The runs were carefully timed using a stop-watch. These times were the test results.

The inventive runs 11–20 were done in the same fashion except that dimethyl selenide had been added to the fuel in the amount of about 1.5 ppm as previously described.

The run times for both Control and Test runs are set forth in Tables 1 and 2, respectively.

TABLE 1

| Control | | |
|---|---|---|
| Ex. | Time (min.) | Decimal |
| 1 | 8:32 | 8.53 |
| 2 | 8:29 | 8.48 |
| 3 | 8:30 | 8.50 |
| 4 | 8:28 | 8.47 |
| 5 | 8:27 | 8.45 |
| 6 | 8:28 | 8.47 |
| 7 | 8:30 | 8.50 |
| 8 | 8:31 | 8.52 |
| 9 | 8:29 | 8.48 |
| 10 | 8:30 | 8.50 |

Average: 8.49 minutes/100 ml of control fuel.

TABLE 2

| Inventive | | |
|---|---|---|
| Ex. | Time (min.) | Decimal |
| 11 | 13:48 | 13.80 |
| 12 | 13:42 | 13.70 |
| 13 | 13:28 | 13.46 |
| 14 | 13:49 | 13.82 |
| 15 | 13:30 | 13.50 |
| 16 | 13:25 | 13.42 |
| 17 | 13:35 | 13.58 |
| 18 | 13:30 | 13.50 |
| 19 | 13:35 | 13.58 |
| 20 | 13:25 | 13.42 |

Average: 13.58 minutes using 1.5 ppm of dimethyl selenide

Calculations

Average control run time: 8.49 minutes

Average test run time: 13.58 minutes

These results illustrate the dramatic enhancement of fuel efficiency achieved by the present invention, with the average fuel efficiency being increased by about 60% in the inventive runs.

EXAMPLE 21

Emissions Testing

Samples of automobile exhausts were secured from a 1971 Plymouth Fury and used to conduct comparative tests to observe any reduction in pollutants upon the addition of selenium to the automobile's fuel. All samples were obtained during controlled idling conditions. The samples from the selenium-containing fuel runs were obtained after riding 50 miles with the additive in the fuel tank. The results of exhaust testing are shown in-Table 2.

TABLE 2

| Pollutant | Without Selenium | With Selenium |
|---|---|---|
| Carbon Monoxide | 1.30% | 0.79% |
| Carbon Dioxide | 11.7% | 9.0% |
| Hydrocarbons | 0.12% | 0.039% |
| Nitrogen Oxides | 0.048% | 0.033% |
| Acidity (pH) | 6.5 | 6.3 |
| Conductivity | 0.03% | 0.11 |

In addition to the above results, no difference in carbon deposits were found. It was thus demonstrated that remarkable and advantageous modification of engine exhaust emission characteristics can be obtained by the inclusion of selenium in the combusted fuel.

EXAMPLE 22–27

Control and test fuels were combusted in a 4-cylinder 151 cubic inch automobile engine while monitoring various parameters of engine performance with a Superflow Model 901T dynamometer from Superflow, Colorado Springs, Colo., U.S.A. The engine was mounted in an engine room with all services supplied remotely and with all operational parameters being measured by remote sensors and with data being recorded and analyzed by computer. In particular, one control, denoted "C-1" was Sunoco 87 octane gasoline. Another control, "C-2" was Jiffy 87 octane gasoline (which contains 10% alcohol). The test fuels were as follows:

T-1: Sunoco 87 octane gasoline containing 1 part per million dimethylselenide;

T-2: Sunoco 87 octane gasoline with 10 ppm dimethylselenide;

T-3: Jiffy 87 octane gasoline with 10 ppm dimethylselenide;

T-4: Sunoco 87 octane gasoline with 100 ppm dimethylselenide;

Details and results of the testing are set forth in Tables 3–9 below, in which the following standard abbreviations are used: CBTrq=foot pounds torque; CBPwr=horsepower; FHp=frictional horsepower; VE %=volumetric efficiency; ME %=mechanial efficiency; FA pounds of fuel used per hour; A/F—air to fuel ratio; BSFC=pounds of fuel per hour/horsepower; CAT=carburator air temperature; Oil=oil temperature; Wat=water temperature. It will be noted that the fuel denoted T-1 was run in two tests to demonstrate reproducability. As can be seen, horsepower, torque and certain other parameters remain almost constant, and certainly within significant limits, and the air to fuel ratio goes from about 11 with the control gasolines to about 15 with the test gasolines. Thus, the engine is employing 36% less fuel when the fuel contains dimethylselenide. Similarly, the amount of fuel used per horsepower (1 b/Hphr) is reduced from about 0.80 (0.76–0.83) in the control gasoline, to about 0.60 (0.58–0.63) in the test gasoline. This again demonstrates that the engine is using about 36% less fuel with the dimethylselenide present, to produce the same power. These results further indicate that selenium has the capacity to increase power output by an engine employing either regular gasoline or gasoline blended with 10% alcohol. The increase in each case is approximately 36% in the tests performed.

TABLE 3

Fuel C-1
Standard Corrected Data for 29.92 Inches Hg, 60° F. Dry Air

| | | |
|---|---|---|
| Test: Data Recorded Manually | Fuel Spec. Grav: 0.703 | Air Sensor: 6.5 |
| Vapor Pressure: 0.40 | Barometric Pres.: 29.15 | Ratio: 1.00 to 1 |
| Engine Type: 4-Cycle Spark | Engine Displacement: 151.0 | Stroke: 3,000 |

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1938 | 127.4 | 47.0 | 6.6 | 105.0 | 87.3 | 34.5 | 87.3 | 11.6 | 0.76 | 49 | 0 | 166 | 8.81 |
| 1940 | 127.2 | 47.0 | 6.6 | 105.6 | 87.2 | 35.3 | 87.9 | 11.4 | 0.78 | 49 | 0 | 166 | 8.87 |
| 1941 | 127.4 | 47.1 | 6.7 | 106.1 | 87.3 | 36.2 | 88.4 | 11.2 | 0.79 | 49 | 0 | 166 | 8.95 |
| 1940 | 127.4 | 47.1 | 6.6 | 106.5 | 87.3 | 37.1 | 88.7 | 11.0 | 0.82 | 49 | 0 | 166 | 8.95 |
| 1940 | 127.4 | 47.1 | 6.6 | 106.8 | 87.3 | 37.1 | 88.9 | 11.0 | 0.82 | 49 | 0 | 166 | 8.97 |
| 1943 | 127.4 | 47.1 | 6.7 | 106.8 | 87.3 | 37.0 | 89.1 | 11.1 | 0.81 | 49 | 0 | 166 | 8.97 |
| 1943 | 127.4 | 47.2 | 6.7 | 107.1 | 87.3 | 36.8 | 89.3 | 11.1 | 0.81 | 49 | 0 | 166 | 8.97 |
| 1940 | 127.6 | 47.1 | 6.6 | 107.4 | 87.3 | 36.7 | 89.6 | 11.2 | 0.80 | 48 | 0 | 166 | 9.00 |
| 1939 | 127.3 | 47.0 | 6.6 | 107.5 | 87.3 | 36.8 | 89.6 | 11.2 | 0.81 | 48 | 0 | 166 | 9.04 |
| 1943 | 127.3 | 47.1 | 6.7 | 107.4 | 87.3 | 37.4 | 89.7 | 11.0 | 0.82 | 48 | 0 | 166 | 9.03 |
| 1942 | 127.6 | 47.2 | 6.7 | 107.5 | 87.3 | 37.4 | 89.8 | 11.0 | 0.82 | 48 | 0 | 166 | 9.02 |
| 1939 | 126.7 | 46.8 | 6.6 | 107.7 | 87.2 | 37.7 | 89.8 | 10.9 | 0.83 | 48 | 0 | 166 | 9.10 |

TABLE 4

Fuel C-2
Standard Corrected Data for 29.92 Inches Hg, 60° F. Dry Air

| | | |
|---|---|---|
| Test: Data Recorded Manually | Fuel Spec. Grav: 0.703 | Air Sensor: 6.5 |
| Vapor Pressure: 0.40 | Barometric Pres.: 29.15 | Ratio: 1.00 to 1 |
| Engine Type: 4-Cycle Spark | Engine Displacement: 151.0 | Stroke: 3,000 |

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1941 | 125.1 | 46.2 | 6.7 | 106.4 | 87.1 | 35.2 | 88.6 | 11.6 | 0.79 | 49 | 0 | 168 | 9.08 |
| 1938 | 125.1 | 46.2 | 6.6 | 106.8 | 87.1 | 32.4 | 87.8 | 12.6 | 0.72 | 49 | 0 | 168 | 9.12 |

TABLE 4-continued

Fuel C-2

Standard Corrected Data for 29.92 Inches Hg, 60° F. Dry Air

| | | | | | | | | | | | | | |
|---|---|---|---|---|---|---|---|---|---|---|---|---|---|
| 1936 | 124.4 | 45.9 | 6.6 | 107.0 | 87.0 | 30.1 | 88.9 | 13.6 | 0.68 | 49 | 0 | 168 | 9.19 |
| 1938 | 124.4 | 45.9 | 6.6 | 107.0 | 87.0 | 30.2 | 88.0 | 13.5 | 0.68 | 49 | 0 | 168 | 9.20 |
| 1938 | 121.4 | 45.9 | 6.6 | 107.3 | 87.0 | 30.8 | 89.2 | 13.3 | 0.69 | 49 | 0 | 168 | 9.22 |
| 1940 | 124.1 | 45.8 | 6.6 | 107.3 | 87.0 | 31.2 | 89.3 | 13.1 | 0.70 | 49 | 0 | 168 | 9.23 |
| 1941 | 124.1 | 45.9 | 6.7 | 107.4 | 87.0 | 30.7 | 89.5 | 13.4 | 0.69 | 49 | 0 | 168 | 9.25 |
| 1941 | 124.1 | 45.9 | 6.7 | 107.6 | 87.0 | 30.4 | 89.6 | 13.5 | 0.68 | 49 | 0 | 168 | 9.26 |
| 1941 | 123.9 | 45.8 | 6.7 | 107.7 | 86.9 | 30.3 | 89.7 | 13.6 | 0.68 | 49 | 0 | 168 | 9.29 |

TABLE 5

Fuel T-1(a)

Standard Corrected Data for 29.92 Inches Hg, 60° F. Dry Air

Test: Data Recorded Manually
Vapor Pressure: 0.40
Engine Type: 4-Cycle Spark

Fuel Spec. Grav: 0.703
Barometric Pres.: 29.15
Engine Displacement: 151.0

Air Sensor: 6.5
Ratio: 1.00 to 1
Stroke: 3,000

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1937 | 126.4 | 46.6 | 6.6 | 106.2 | 87.2 | 28.3 | 88.1 | 14.3 | 0.63 | 50 | 0 | 167 | 8.99 |
| 1940 | 126.4 | 46.7 | 6.6 | 106.4 | 87.2 | 27.8 | 88.4 | 14.6 | 0.62 | 50 | 0 | 167 | 9.00 |
| 1941 | 126.4 | 45.7 | 6.7 | 106.7 | 87.2 | 27.1 | 88.7 | 15.0 | 0.60 | 50 | 0 | 167 | 9.03 |
| 1940 | 126.4 | 45.7 | 6.6 | 106.0 | 87.2 | 26.8 | 88.7 | 15.2 | 0.59 | 51 | 0 | 167 | 9.03 |
| 1939 | 126.2 | 45.6 | 6.6 | 106.2 | 87.1 | 26.6 | 88.8 | 15.3 | 0.59 | 51 | 0 | 167 | 9.06 |
| 1939 | 125.9 | 45.5 | 6.6 | 106.2 | 87.1 | 26.4 | 88.8 | 15.4 | 0.59 | 51 | 0 | 167 | 9.08 |
| 1941 | 125.9 | 45.5 | 6.7 | 106.2 | 87.1 | 26.2 | 88.9 | 15.6 | 0.58 | 51 | 0 | 167 | 9.09 |
| 1940 | 125.9 | 45.5 | 6.6 | 106.4 | 87.1 | 26.1 | 89.0 | 15.7 | 0.58 | 51 | 0 | 167 | 9.10 |
| 1939 | 125.7 | 45.4 | 6.6 | 106.5 | 86.1 | 26.1 | 89.0 | 15.7 | 0.58 | 51 | 0 | 167 | 9.12 |
| 1939 | 125.7 | 45.4 | 6.6 | 106.6 | 86.1 | 26.1 | 89.1 | 15.7 | 0.58 | 51 | 0 | 167 | 9.13 |

TABLE 6

Fuel T-1(b)

Standard Corrected Data for 29.92 Inches Hg, 60° F. Dry Air

Test: Data Recorded Manually
Vapor Pressure: 0.40
Engine Type: 4-Cycle Spark

Fuel Spec. Grav: 0.703
Barometric Pres.: 29.15
Engine Displacement: 151.0

Air Sensor: 6.5
Ratio: 1.00 to 1
Stroke: 3,000

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1937 | 126.4 | 46.6 | 6.6 | 106.2 | 87.2 | 28.3 | 88.1 | 14.3 | 0.63 | 50 | 0 | 167 | 8.99 |
| 1940 | 126.4 | 46.7 | 6.6 | 106.4 | 87.2 | 27.8 | 88.4 | 14.6 | 0.62 | 50 | 0 | 167 | 9.00 |
| 1941 | 126.4 | 46.7 | 6.7 | 106.7 | 87.2 | 27.1 | 88.7 | 15.0 | 0.60 | 50 | 0 | 167 | 9.03 |
| 1940 | 126.4 | 46.7 | 6.6 | 107.0 | 87.2 | 26.8 | 88.7 | 15.2 | 0.59 | 51 | 0 | 167 | 9.03 |
| 1939 | 126.2 | 46.6 | 6.6 | 107.2 | 87.1 | 26.6 | 88.8 | 15.3 | 0.59 | 51 | 0 | 167 | 9.06 |
| 1939 | 125.9 | 46.5 | 6.6 | 107.2 | 87.1 | 26.4 | 88.8 | 15.4 | 0.59 | 51 | 0 | 167 | 9.08 |
| 1941 | 125.9 | 46.5 | 6.7 | 107.2 | 87.1 | 26.2 | 88.9 | 15.6 | 0.58 | 51 | 0 | 167 | 9.09 |
| 1940 | 125.9 | 46.5 | 6.6 | 107.4 | 87.1 | 26.1 | 89.0 | 15.7 | 0.58 | 51 | 0 | 167 | 9.10 |
| 1939 | 125.7 | 46.4 | 6.6 | 107.5 | 87.1 | 26.1 | 89.0 | 15.7 | 0.58 | 51 | 0 | 167 | 9.12 |
| 1939 | 125.7 | 46.4 | 6.6 | 107.6 | 87.1 | 26.1 | 89.1 | 15.7 | 0.58 | 51 | 0 | 167 | 9.13 |
| 1936 | 125.7 | 46.7 | 6.6 | 105.8 | 87.2 | 27.1 | 88.1 | 15.9 | 0.60 | 48 | 0 | 166 | 8.93 |
| 1936 | 125.7 | 46.7 | 6.6 | 106.1 | 87.2 | 27.1 | 88.3 | 15.0 | 0.60 | 48 | 0 | 166 | 8.95 |
| 1936 | 125.7 | 46.7 | 6.6 | 106.3 | 87.2 | 26.8 | 88.5 | 15.2 | 0.59 | 48 | 0 | 166 | 8 97 |
| 1938 | 125.7 | 46.8 | 6.6 | 106.3 | 87.2 | 26.8 | 85.6 | 15.2 | 0.59 | 48 | 0 | 166 | 8.98 |
| 1937 | 125.7 | 46.7 | 6.6 | 106.6 | 87.2 | 26.9 | 88.8 | 15.2 | 0.59 | 48 | 0 | 166 | 9.00 |
| 1938 | 125.7 | 46.8 | 6.6 | 106.7 | 87.2 | 26.7 | 88.9 | 15.3 | 0.59 | 48 | 0 | 166 | 9.01 |
| 1930 | 125.7 | 46.8 | 6.6 | 106.7 | 87.2 | 26.5 | 89.0 | 15.4 | 0.58 | 48 | 0 | 166 | 9.00 |
| 1932 | 125.6 | 46.8 | 6.7 | 106.8 | 87.2 | 26.4 | 89.3 | 15.5 | 0.58 | 47 | 0 | 166 | 9 03 |
| 1931 | 125.4 | 46.7 | 6.7 | 106.9 | 87.2 | 26.5 | 89.4 | 15.7 | 0.58 | 47 | 0 | 166 | 9.06 |
| 1932 | 125.4 | 46.7 | 6.7 | 107.0 | 87.2 | 26.4 | 89.5 | 15.6 | 0.58 | 47 | 0 | 166 | 9.07 |

TABLE 7

Fuel T-2
Standard Corrected Data for 29.92 Inches Hg, 60° F. Dry Air

Test: Data Recorded Manually | Fuel Spec. Grav: 0.703 | Air Sensor: 6.5
Vapor Pressure: 0.40 | Barometric Pres.: 29.14 | Ratio: 1.00 to 1
Engine Type: 4-Cycle Spark | Engine Displacement: 151.0 | Stroke: 3,000

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1934 | 125.7 | 46.3 | 6.6 | 105.0 | 87.1 | 26.3 | 86.9 | 15.3 | 0.58 | 50 | 0 | 167 | 8.92 |
| 1936 | 125.9 | 46.4 | 6.6 | 105.4 | 87.1 | 26.8 | 87.3 | 15.3 | 0.58 | 50 | 0 | 167 | 8.94 |
| 1934 | 126.2 | 46.5 | 6.6 | 105.9 | 87.1 | 26.1 | 87.6 | 15.3 | 0.59 | 50 | 0 | 167 | 8.96 |
| 1933 | 125.7 | 46.3 | 6.6 | 106.2 | 87.1 | 26.8 | 87.8 | 15.3 | 0.59 | 50 | 0 | 167 | 9.02 |
| 1935 | 125.9 | 46.4 | 6.6 | 106.3 | 87.1 | 26.6 | 88.0 | 15.5 | 0.58 | 50 | 0 | 168 | 9.02 |
| 1935 | 125.7 | 46.3 | 6.6 | 106.5 | 87.1 | 25.4 | 88.2 | 15.9 | 0.57 | 50 | 0 | 168 | 9.06 |
| 1936 | 125.9 | 46.4 | 6.6 | 106.6 | 87.1 | 25.2 | 88.3 | 16.0 | 0.57 | 50 | 0 | 168 | 9.05 |
| 1933 | 125.7 | 46.3 | 6.6 | 106.8 | 87.1 | 25.1 | 88.3 | 15.9 | 0.57 | 50 | 0 | 168 | 9.07 |
| 1933 | 125.2 | 46.1 | 6.6 | 106.9 | 87.0 | 25.1 | 88.4 | 15.7 | 0.58 | 50 | 0 | 168 | 9.12 |
| 1934 | 125.2 | 46.1 | 6.6 | 106.8 | 87.0 | 26.1 | 88.4 | 15.6 | 0.59 | 50 | 0 | 169 | 9.12 |
| 1932 | 125.2 | 46.1 | 6.6 | 175.2 | 87.0 | 26.1 | 88.5 | 15.4 | 0.59 | 50 | 0 | 169 | 9.13 |

TABLE 8

Fuel T-3
Standard Corrected Data for 29.92 Inches Hg, 60° F. Dry Air

Test: Data Recorded Manually | Fuel Spec. Grav: 0.703 | Air Sensor: 6.5
Vapor Pressure: 0.40 | Barometric Pres.: 29.12 | Ratio: 1.00 to 1
Engine Type: 4-Cycle Spark | Engine Displacement: 151.0 | Stroke: 3,000

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1935 | 125.0 | 46.1 | 6.6 | 106.5 | 87.0 | 26.3 | 88.2 | 15.4 | 0.59 | 50 | 0 | 167 | 9.12 |
| 1934 | 125.0 | 46.0 | 6.6 | 107.2 | 87.0 | 26.5 | 88.6 | 15.4 | 0.60 | 50 | 0 | 167 | 9.16 |
| 1934 | 124.8 | 46.0 | 6.6 | 107.3 | 87.0 | 26.7 | 88.7 | 15.3 | 0.60 | 50 | 0 | 166 | 9.19 |
| 1935 | 124.3 | 45.8 | 6.6 | 107.3 | 86.9 | 26.6 | 88.8 | 15.3 | 0.60 | 50 | 0 | 167 | 9.22 |
| 1939 | 124.5 | 46.0 | 6.6 | 107.3 | 87.0 | 26.4 | 88.9 | 15.5 | 0.60 | 50 | 0 | 167 | 9.21 |
| 1940 | 124.5 | 46.0 | 6.6 | 107.3 | 87.0 | 26.4 | 89.0 | 15.5 | 0.59 | 50 | 0 | 167 | 9.20 |
| 1940 | 124.5 | 46.0 | 6.6 | 107.3 | 87.0 | 26.1 | 89.0 | 15.7 | 0.59 | 50 | 0 | 167 | 9.20 |
| 1939 | 124.8 | 46.1 | 6.6 | 107.4 | 87.0 | 25.8 | 89.0 | 15.8 | 0.58 | 50 | 0 | 167 | 9.18 |
| 1938 | 124.6 | 46.0 | 6.6 | 107.4 | 87.0 | 25.5 | 89.2 | 16.1 | 0.57 | 49 | 0 | 167 | 9.22 |
| 1933 | 124.2 | 45.7 | 6.6 | 107.5 | 87.0 | 25.4 | 89.1 | 16.1 | 0.57 | 49 | 0 | 167 | 9.25 |

TABLE 9

Fuel T-4
Standard Corrected Data for 29.92 Inches Hg, 60° F. Dry Air

Test: Data Recorded Manually | Fuel Spec. Grav: 0.703 | Air Sensor: 6.5
Vapor Pressure: 0.40 | Barometric Pres.: 29.11 | Ratio: 1.00 to 1
Engine Type: 4-Cycle Spark | Engine Displacement: 151.0 | Stroke: 3,000

| Speed rpm | CBTrq lb-Ft | CBPwr Hp | FHp Hp | VE % | ME % | FA lb/hr | Al scfm | A/F | BSFC lb/Hphr | CAT | Oil | Wat | BSAC lb/Hphr |
|---|---|---|---|---|---|---|---|---|---|---|---|---|---|
| 1944 | 125.9 | 46.6 | 6.7 | 106.2 | 87.1 | 26.4 | 88.2 | 15.3 | 0.59 | 50 | 0 | 166 | 9.02 |
| 1947 | 126.1 | 46.7 | 6.7 | 106.4 | 87.1 | 26.3 | 88.5 | 15.5 | 0.58 | 50 | 0 | 166 | 9.01 |
| 1947 | 126.4 | 46.9 | 6.7 | 106.5 | 87.1 | 26.0 | 88.6 | 15.6 | 0.58 | 50 | 0 | 166 | 9.00 |
| 1942 | 125.9 | 46.6 | 6.7 | 106.7 | 87.1 | 25.7 | 88.6 | 15.8 | 0.57 | 50 | 0 | 166 | 9.06 |
| 1942 | 125.9 | 46.6 | 6.7 | 106.9 | 87.1 | 25.7 | 88.7 | 15.8 | 0.57 | 50 | 0 | 166 | 9.07 |
| 1939 | 125.2 | 46.2 | 6.6 | 106.9 | 87.0 | 26.1 | 88.8 | 15.6 | 0.59 | 49 | 0 | 166 | 9.14 |
| 1940 | 124.7 | 46.1 | 6.6 | 106.8 | 87.0 | 26.3 | 88.8 | 15.5 | 0.59 | 49 | 0 | 166 | 9.16 |
| 1943 | 124.7 | 46.1 | 6.7 | 106.7 | 87.0 | 25.8 | 88.8 | 15.8 | 0.58 | 49 | 0 | 166 | 9.16 |

EXAMPLE 28

Dimethylselenide is added to fuel oil amounts ranging from 1 to 100 ppm. The fuel oil is conventionally combusted and upon doing so the amount of thermal energy (e.g. BTU's) obtained per unit (weight or volume) of fuel combusted is increased, ranging up to 5% and above.

While the invention has been illustrated and described in detail in the foregoing description, the same is to be considered as illustrative and not restrictive in character, it being understood that only the preferred embodiment has been described and that all changes and modifications that come within the spirit of the invention are desired to be protected.

What is claimed is:

1. A method of enhancing fuel efficiency of an internal combustion engine, comprising including in the fuel upon which the engine is operating an effective amount of a di-organic selenide.

2. The method of claim 1 wherein the fuel is gasoline.

3. A method of claim 2 wherein the di-organic selenide is a dialkyl selenide.

4. The method of claim 3 wherein the dialkyl selenide has alkyl groups selected from the group consisting of methyl, ethyl, propyl, butyl, and pentyl.

5. The method of claim 4 wherein the dialkyl selenide is dimethyl selenide or diethyl selenide.

6. The method of claim 5 wherein the dialkyl selenide is dimethyl selenide.

7. A method of claim 3 wherein the fuel is gasoline.

8. A method of claim 4 wherein the fuel is gasoline.

9. A method of claim 5 wherein the fuel is gasoline.

10. A method of modifying the exhaust emission of an internal combustion engine operating on a fuel, comprising including in the fuel an effective amount of a di-organic selenide to modify said exhaust emission.

11. The method of claim 10 wherein the fuel is gasoline.

12. The method of claim 10 wherein the di-organic selenide is a dialkyl selenide.

13. A method of claim 12 wherein the dialkyl selenide has alkyl groups selected from the group consisting of methyl, ethyl, propyl, butyl, and pentyl.

14. A method of claim 13, wherein the dialkyl selenide is diethyl selenide.

15. A method of claim 13, wherein the dialkyl selenide is dimethyl selenide.

16. A method of claim 13, wherein the fuel is gasoline.

17. A modified internal combustion engine fuel which includes an effective amount of a di-organic selenide to increase the fuel efficiency of an internal combustion engine operating on the fuel.

18. A modified internal combustion engine fuel which includes an effective amount of a di-organic selenide to abate the exhaust emission of carbon dioxide of an internal combustion engine operating on the fuel.

19. A method for increasing the thermal energy generated upon combusting fuel oil in a flame, comprising incorporating in the fuel oil an effective amount of selenium to increase the thermal energy generated when the fuel oil is combusted.

20. A method for improving the fuel efficiency of an internal combustion engine, comprising operating the internal combustion engine by combusting a fuel for the engine incorporating an effective amount of a di-organic selenide to increase the fuel efficiency of the engine.

21. A method of claims 20, wherein the di-organic selenide is a dialkyl selenide.

22. A method of claim 21, wherein the dialkyl selenide has alkyl groups selected from the group consisting of methyl, ethyl, propyl, butyl and pentyl.

23. A method of claim 22, wherein the dialkyl selenide is diethyl selenide.

24. A method of claim 22, wherein the dialkyl selenide is dimethyl selenide.

* * * * *

UNITED STATES PATENT AND TRADEMARK OFFICE

CERTIFICATE OF CORRECTION

PATENT NO : 5,858,027

DATED : January 12, 1999

INVENTOR(S) : Charles E. Cameron

It is certified that error appears in the above-identified patent and that said Letters Patent is hereby corrected as shown below:

In col. 6, l. 11, please insert — = — in between "FA' and "pounds".

In col. 6, l. 12, please delete the "—" currently in between "A/F" and "air", and insert in lieu thereof — = —.

In col. 12, l. 21, claim 21, please delete "claims" and insert in lieu thereof —claim—.

Signed and Sealed this

Seventeenth Day of October, 2000

*Attest:*

Q. TODD DICKINSON

*Attesting Officer*

*Director of Patents and Trademarks*